US005413394A

United States Patent [19]

Mitchell

[11] Patent Number: 5,413,394

[45] Date of Patent: May 9, 1995

[54] HANDLING DEVICE FOR A PLASTIC TRASH BAG

[76] Inventor: Marilyn Mitchell, 577 Franklin St., Denver, Colo. 80218

[21] Appl. No.: 189,599

[22] Filed: Jan. 31, 1994

[51] Int. Cl.[6] ..... B65B 67/04

[52] U.S. Cl. ..... 294/1.1; 248/99; 15/257.7

[58] Field of Search ..... 294/1.1, 1.4, 1.5, 55; 248/95, 99, 100, 101; 15/104.8, 257.1, 257.4, 257.7

[56] References Cited

U.S. PATENT DOCUMENTS

| | | | |
|---|---|---|---|
| 1,532,197 | 4/1925 | Nicholas | 15/257.7 X |
| 3,606,436 | 9/1971 | Lynch | 294/1.4 |
| 4,012,067 | 3/1977 | Travis | 294/1.4 |
| 4,048,691 | 9/1977 | Spangler | 294/1.4 X |
| 4,222,597 | 9/1980 | Willis | 294/1.4 |
| 5,004,195 | 4/1991 | McIntyre | 294/1.1 X |
| 5,040,754 | 8/1991 | Dearman | 294/1.1 X |
| 5,149,028 | 9/1992 | Blackaby et al. | 294/1.1 X |
| 5,308,027 | 5/1994 | Fullilove | 294/99 X |

*Primary Examiner*—Dean J. Kramer
*Attorney, Agent, or Firm*—Charles C. Corbin

[57] ABSTRACT

Disclosed is a handling device for a plastic trash bag including a bag-support frame having a general D-shaped configuration including a base and an arching portion having an apex, and an elongate tubular handle is pivotally connected to the frame apex of the support frame for rotational adjustment about an axis parallel to the frame base such that the handle can be rotated to, and frictionally supported in a variety of angles with respect to the plane of the frame. A resiliently spreadable clamp ring embraces the handle, and the open mouth of a trash bag can overlap the frame, and a portion of the bag can be embraced between the clamp and the handle to temporarily secure the bag in place.

5 Claims, 1 Drawing Sheet

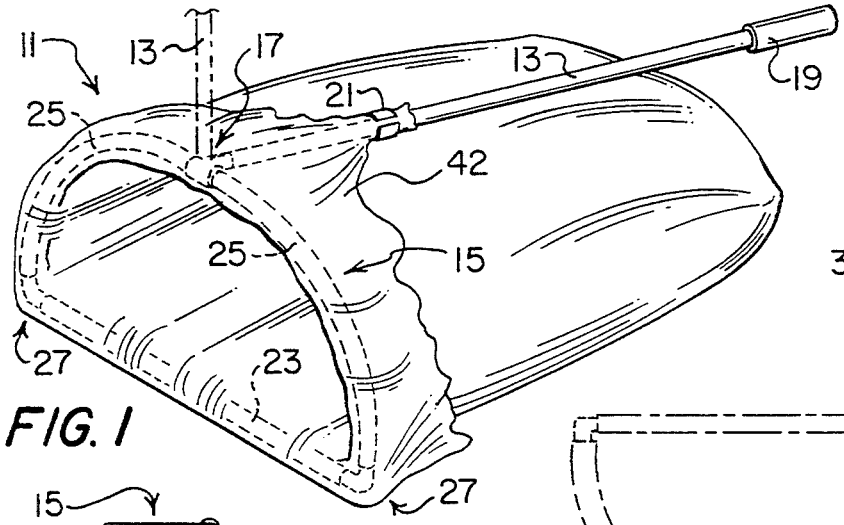
FIG. 1
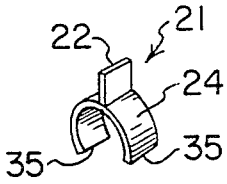
FIG. 10
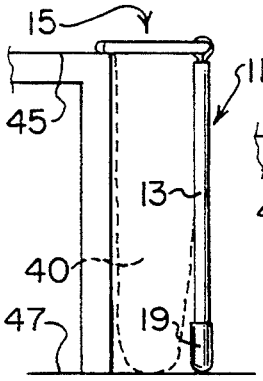
FIG. 6
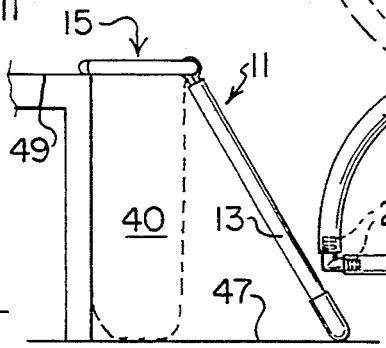
FIG. 7
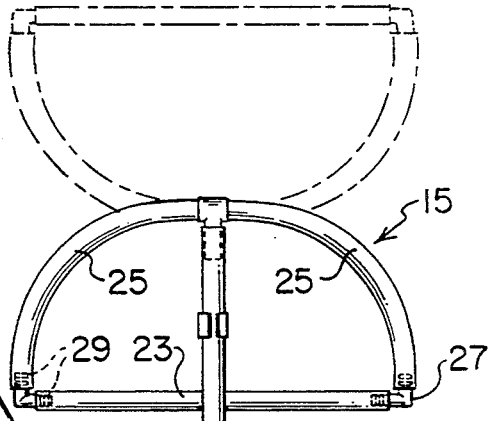
FIG. 2
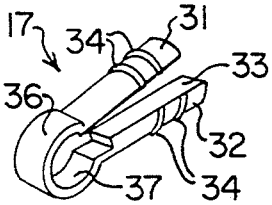
FIG. 8
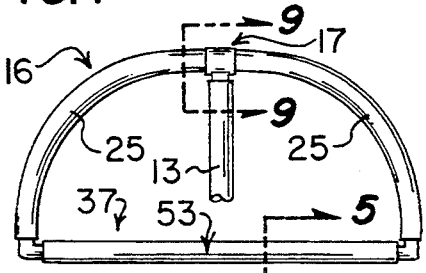
FIG. 4
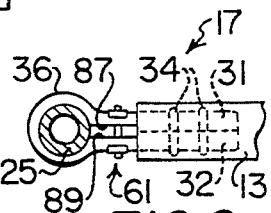
FIG. 9
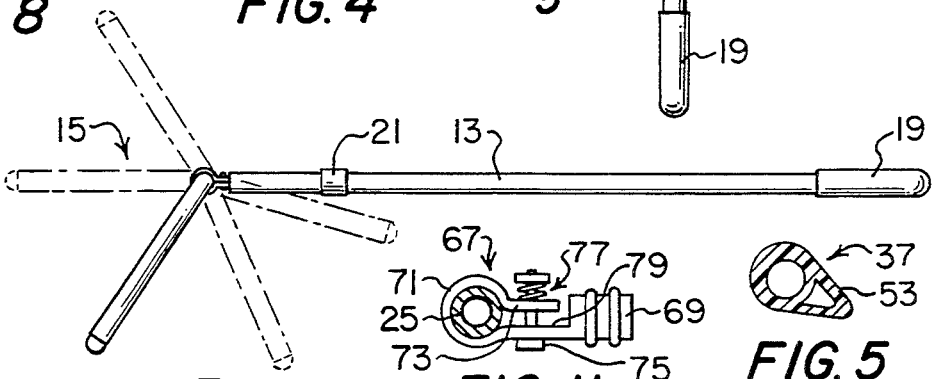
FIG. 3
FIG. 11
FIG. 5

HANDLING DEVICE FOR A PLASTIC TRASH BAG

BACKGROUND OF THE INVENTION

1. Field of the Invention

The present invention relates to devices for releasably mounting plastic trash bags and holding the mouth of the bag open. More particularly, the present invention relates to such a device with an adjustable configuration, and which can be disposed in a variety of bag-supporting configurations to hold the bag upright as well as in a horizontal position.

2. Description of the Prior Art

Receptacle bags for collecting lawn debris, trash and other materials are generally made of very flexible polyethylene and can be difficult for one person to load and fill. Thus the prior art includes several examples of devices for handling flexible plastic refuse bags so as to facilitate the filling of the bag by holding the bag mouth open. Examples of prior designs are shown in U.S. Pat. Nos. 5,031,948, 4,768,742, 4,048,691, 3,733,099, and 3,711,141. These all include some kind of a handle connected to a rigid support frame that is designed to hold the mouth of the bag open, and feature various methodologies for releasably attaching the bag to the support frame, to support the bag in a horizontally disposed loading position or in an upright loading position. While each of the aforementioned arrangements facilitate in particular ways the task of collecting refuse in a garbage bag, they nevertheless have limitations and drawbacks, and there remains the need for further improvement to the state of the art of bag supporters. For example, there are certain applications to which prior designs do not lend themselves.

SUMMARY OF THE INVENTION

In view of the foregoing, it is a general object of the present invention to provide further improvements in the state of such trash bag handling devices.

Another more particular object of the present invention is to provide a bag handling device having an adjustable configuration such that it can be propped against and partially supported by horizontal surfaces of various elevations above the floor or ground in order to hold a vertically disposed bag.

A further object is to provide such a device that can be quickly changed from its fold-away position to a self-supporting position on a horizontal support surface for holding an open bag in a horizontally extending position, and which also is readily and quickly changed from its fold-away position to various configurations for holding a bag upright.

Another object of the invention is to provide a bag handler that permits the user to easily and quickly secure a bag to the device.

Yet another object is to provide an efficient lightweight device that can be quickly and easily adjusted to a fold-away configuration for transport and storage.

Yet a further object is to provide such a device that can be easily and economically fabricated so as to be made available to the purchasing public at a relatively inexpensive price.

Accordingly, these objects and purposes of the present invention, and others, are provided in brief, in the form of a device that includes a generally D-shaped frame having a base, and an arching portion having an apex. There is a tubular, elongated handle that has a hand grip attached at its free end, the other end being connected to the frame apex by way of a connector member which allows the handle to be pivoted against a residual holding frictional force about an axis that is parallel to the base of the frame, such that the angle between the plane of the frame and the handle can be substantially adjusted, the static frictional holding force of the connector being sufficient to hold the frame at any selected angle to which it is adjusted.

Finally, there is clamping means comprising clamps that can releasably and resiliently embrace the handle, near the frame, the clamps also being engagable over the frame at random locations therealong. The frame is adapted to have a marginal edge portion of the open end of a flexible trash bag overlapped thereover, and a part of this marginal portion can be engaged around the handle and releasably secured thereto by the clamping means. In some instances, clamps can be engaged over the bag-covered frame for additional holding. With the bag thusly mounted, the device can be set in a stable, self supporting configuration with the frame base and the handle free end engaging the ground, the components angled so that the bag mouth is held in a vertical plane. The device is also capable of adjustment to various angular configurations to allow the frame base to be propped against a first horizontal surface, the handle engaging a second lower horizontal surface, the bag mouth being supported in a horizontal plane.

In one embodiment, spring means is used to control the frictional holding force of the connector, and in another embodiment a screw mechanism lends adjustability to this force. In yet another embodiment, at least two brackets are included, each bracket having an opening for freely receiving the device handle, the brackets being securable to a vertical wall in vertically spaced-apart relation such that the device, with handle engaged in the bracket openings, is releasably held in an upright position with the handle perpendicular to the plane of the frame.

BRIEF DESCRIPTION OF THE DRAWINGS

FIG. 1 is a front perspective view illustrating a refuse bag handling device according to the present invention, deployed on a horizontal support surface;

FIG. 2 is a top plan view of the device of FIG. 1, illustrating a folded configuration of the invention;

FIG. 3 is a side elevational view of the device of FIG. 2;

FIG. 4 is a front view of a variant of the present invention;

FIG. 5 is a sectional view taken along the line 5—5 of FIG. 4;

FIG. 6 is a side elevational view that illustrates a device according to the invention, supporting a plastic refuse bag in one of many possible upright positions;

FIG. 7 is a similar view to FIG. 6 showing another of the various configurations the device of the invention can have;

FIG. 8 is an enlarged perspective view of a T-connector employed in a device according to the invention;

FIG. 9 is an enlarged partial sectional view taken along line 9—9 of FIG. 4;

FIG. 10 is a perspective view of a ring clamp used with the invention; and

FIG. 11 is a partial side elevational view of a T-connector used in a variant of the invention.

DETAILED DESCRIPTION OF THE INVENTION

Referring now to the drawings, FIGS. 1 and 2 show a preferred embodiment of the invention in the form of a refuse bag handler 11, the main components of which include an elongated handle 13, a bag support frame 15, a T-connector 17, a hand grip 19 and at least one ring clamp 21.

Device 11 is comprised primarily of plastic parts which are fabricated using techniques well known in the plastics forming industry. The support frame 15, which has a D-configuration, is made of an extruded tubular plastic of suitable strength and durability. It includes a straight tubular base 23 and a tubular arch 25 that has opposite lower ends affixed to the base 23 by way of a pair of conventional plastic L-connectors 27. Legs 29 of the L-connectors 27 are received tightly within the tubular ends of base 23 and arch 25, and they are equipped with a conventional arrangement of circumferential barbs which are shaped to resist removal after installation as illustrated.

At the apex of arch 25 is provided the T-connector 17 that is best described by reference to FIGS. 4, 8 and 9. FIG. 8 shows that T-connector 17, which can be injection molded, has a pair of semi-cylindrical legs 31 and 32 having opposed flat surfaces 33 and rounded surfaces equipped with semi-circular barbs 34. Connector 17 also has a head or clamping portion 36 that features a constrictable recess 37. FIG. 8 illustrates the uninstalled state of connector 17, wherein its legs 31 and 32 can be resiliently spread apart such that connector 17 can be applied over the frame apex which is received within recess 37. To complete installation, legs 32 and 32 are brought together to form a single cylindrical leg that is then force fit within the open end of handle 13, as FIG. 9 shows. When the connector 17 is thusly installed, the frame apex is embraced by the recess 37 with a clamping force that holds the frame against rotation.

Thus a pivotal connection is made between handle 13 and the frame 15. This clamping force represents a static frictional quantity that can be fairly easily overcome by the user who can manipulate the frame through a large range of motion relative to handle 13, as best illustrated in FIG. 3, however, this frictional force is sufficient to hold frame 15 at any angular position in which it is set relative to handle 13 during application and use of the device 11 as will be described hereinafter. Note that FIG. 9 also illustrates the use of a screw assembly 61 that can be tightened to increase the clamping force of connector 17, should it be desired to make such an adjustment. Although the flat surfaces 33 of the installed connector 17 firmly engage one another as FIG. 9 illustrates, there are oppositely disposed recessed surfaces at 87 and 89 that can be moved towards each other by the tightening of the screw assembly 61.

The hand grip 19 is preferably constructed of a suitable resilient polymeric material such as a foam rubber and can be a hollow structure that is force fit over the end of handle 13 or attached by a suitable adhesive. It is preferable, for reasons that will be apparent, that end grip 19 or at least the end of hand grip 19, be constructed of a non-slip material.

The open ring clamp 21 is of a flexible resilient plastic construction and at least one is mounted over handle 13, near the T-connector 17, in embracing relationship. As FIG. 10 best shows, ring clamp 21 includes a tab 22 that extends outwardly from ring portion 24, at a location opposite the gap between edges 35. The ring clamp 21 is adapted to be readily removed from the handle 12 when the tab 22 is pulled outwardly by hand, causing the edges 35 to resiliently spread apart as the clamp is thusly dislodged. By using one hand, one can install a ring clamp 21 over the handle 13 or the frame 15, by pushing it gap-first into engagement with these parts. The gap is set to be sufficiently wide such that the edges 35 will be resiliently cammed apart when they slidably engage the curved wall of these tubular parts of the device 11.

FIG. 4 depicts a variant of the invention in the form of a bag handling device 16 which has the same construction as the embodiment described above, with the exception of having a frame base 37 that is equipped with an integral ramp or lip 53 as shown in FIG. 5. This construction is intended to provide base 37 with a shape that facilitates the sweeping of refuse material into the mouth of a bag mounted over the frame of device 12.

In yet another embodiment of the invention a connector 67 shown in FIG. 11 is used. Connector 67 has a construction that enhances the ability to embrace the apex of frame 15 with a force that does not diminish due to any eroding of the surface of the frame that may occur after extensive use of device 11. This connector has a barb-equipped end 69 and features a constrictable clamping portion 71 that has a free end 73. A retaining bolt assembly 75, including a bolt that passes through a bore in end 73, retains a compression spring 77 that pushes downwardly on end 73 causing member 25 to be held with the desired frictional force. Note that spacing is provided between the bottom of free end 73 and an opposing surface 79, which spacing allows end 73 to be self-adjusted downwardly in the event there is any eroding of frame member 25, while allowing spring 77 to continue to exert a desirable damping force.

Device 15 lends itself to being conveniently stored in an upright position against a vertical wall, with the use of a pair of vertically spaced wall-mounted brackets 81, as illustrated in FIG. 2. Each bracket 81 has an opening sufficient to easily receive therethrough the handle 13 and grip 19.

While the above-described preferred embodiments are made of plastic, it is also contemplated that devices according to the present invention can be suitably fashioned of a metallic material, such as aluminum.

Having described the construction of device 11, its advantageous and convenient use and operation will now be described with reference to depictions in FIGS. 1, 6 and 7. A suitable large plastic bag 40, shown in FIG. 1, can be easily installed on device 11 by passing the open end of bag 40 forwardly through the opening of frame 15 and then overlapping a marginal edge portion 41 back over the frame base and side arms. A leader portion 42 of the bag can then be pulled rearwardly and taut, and gathered about the handle 13. A ring clamp 21 can then be snapped over the gathered portion 42 to releasably hold it in place. This will be seen to suffice to hold the mouth of bag 40 secured about the frame 15. Depending upon the weight of refuse being collected in bag 40, additional clamps 21 can be snapped over various spaced-apart locations along the bag-covered frame 15.

FIG. 1 illustrates how device 11 is used for supporting bag 40 on a generally flat support surface, such as a lawn or the floor of a building. Note that the user has manipulated device 11 into a very stable ground-engaging configuration in which it supports itself with the frame 15 held in a generally vertical plane. It is obvious that this will facilitate the sweeping and gathering of refuse and other material from the ground or from the floor into the open mouth of bag 40.

The user may also manipulate device 11 into the configuration shown in phantom lines in FIG. 1 and in FIG. 2, and then hold the handle 13 in one hand and operating a suitable broom or raking implement in the other. Thus with frame base 23 held against the ground, the refuse material may be easily gathered within the open mouth of bag 40. Another advantageous application (not shown) of device 11 when in the configuration shown in phantom lines in FIG. 2, is as a bed-side refuse collector. Here the horizontally disposed device 11 is inserted between the matresses of a bed, the entire handle and a small portion of the frame being sandwiched between the matresses. This allows a bag to be vertically supported adjacent the bed. FIG. 6 shows how a device 11 can be used to support bag 40 in a vertical orientation with the frame base 23 engaging an elevated horizontal surface 45 and the bottom of handle 19 engaged against a lower horizontal surface 47. In FIG. 7 the same device 11 is shown. As here shown the frame 15 still maintains the open mouth of bag 15 in a horizontal plane, with frame 15 engaged with a horizontal support surface 49 that is obviously at a lower elevation than the support surface 45 shown in FIG. 6. This is easily accomplished by virtue of manipulating handle 13 to a larger angle with respect to frame 15.

Finally it is noted that device 11 can be manipulated into the compact configuration shown in FIG. 2 for storage or transport.

While certain preferred embodiments of the invention have been described, it should be understood that the invention is not limited thereto, since there are many variations that will be readily apparent to those skilled in the art. Thus, it is intended that the invention be given the broadest possible interpretation within the terms of the claims which follow.

What is claimed is:

1. A device for handling a flexible, disposable plastic trash bag of the type having an opening defined by a marginal edge portion, said device comprising:

a. a frame having a general D-shaped configuration and including a base, and an arching member that has an apex;

b. an elongate tubular handle adapted for gripping by the operator of said device and having a free end with a hand grip attached thereto, and an opposite end adapted to be connected to said frame;

c. means for pivotally connecting said opposite handle end to the apex of said frame for adjustable movement about an axis parallel to the base of said frame, said connecting means having a static frictional gripping force that is sufficient to hold said handle at a selected angle with respect to the plane of said frame, said handle being pivotable against said force by said operator to vary the angular orientation of said handle with respect to the plane of said frame, and wherein said connecting means comprises a T-connector having a middle member and a frame-embracing cross portion, said middle member secured to said handle opposite end, and said cross portion having a recessed portion for receiving and adjustably embracing said frame apex.

2. A device as defined in claim 1 including a pair of L-connectors connecting said frame arching members to said base.

3. A device as defined in claim 1 including bracket means for releasably mounting said device to a vertical wall, said bracket means including at least two brackets adapted for being secured to said wall in vertically spaced apart relation, each of said brackets having an opening sufficiently large to freely receive said handle, said vertically spaced brackets capable of supporting said device in an upright position with said handle vertical, and said handle generally perpendicular to the plane of said frame.

4. A device for handling a flexible, disposable plastic trash bag of the type having an opening defined by a marginal edge portion, said device comprising:

a. a frame having a general D-shaped configuration and including a base, and an arching member that has an apex;

b. an elongate tubular handle adapted for gripping by the operator of said device and having a free end with a hand grip attached thereto, and an opposite end adapted to be connected to said frame;

c. means for pivotally connecting said opposite handle end to the apex of said frame for adjustable movement about an axis parallel to the base of said frame, said connecting means having a static frictional gripping force that is sufficient to hold said handle at a selected angle with respect to the plane of said frame, said handle being pivotable against said force by said operator to vary the angular orientation of said handle with respect to the plane of said frame, and wherein said connecting means comprises a T-connector having a middle member and a frame-embracing cross portion, said middle member secured to said handle opposite end, and said cross portion having a recessed portion for receiving and adjustably embracing said frame apex, and wherein said recessed portion includes surfaces that are adapted to be adjustably constricted and including a screw mechanism for causing said constriction.

5. A device for handling a flexible disposable plastic trash bag of the type having an opening defined by a marginal edge portion, said device comprising:

a. a frame having a general D-shaped member that has an apex;

b. an elongate tubular handle adapted for gripping by the operator of said device and having a free end with a hand grip attached thereto, and an opposite end adapted to be connected to said frame;

c. means for pivotally connecting said opposite handle end to the apex of said frame for adjustable movement about an axis parallel to the base of said frame, said connecting means having a static frictional gripping force that is sufficient to hold said handle at a selected angle with respect to the plane of said frame, said handle being pivotable against said force by said operator to vary the angular orientation of said handle with respect to the plane of said frame, and wherein said connecting means comprises a T-connector having a middle member and a frame-embracing cross portion, said middle member secured to said handle opposite end, and said cross portion having a recess portion for receiving and adjustable embracing said frame apex, and wherein said cross portion includes a free end, and including spring means acting on said free end to cause said recessed portion to constrict upon said frame apex.

* * * * *